US005678439A

United States Patent [19]

Dunwoody et al.

[11] Patent Number: 5,678,439

[45] Date of Patent: Oct. 21, 1997

[54] SPACER

[75] Inventors: Paul Robert Dunwoody; Richard Mark Orlando Golding, both of Oxfordshire, United Kingdom

[73] Assignee: Carnaudmetalbox plc, United Kingdom

[21] Appl. No.: 556,906

[22] PCT Filed: May 20, 1994

[86] PCT No.: PCT/GB94/01085

§ 371 Date: Nov. 29, 1995

§ 102(e) Date: Nov. 29, 1995

[87] PCT Pub. No.: WO94/27758

PCT Pub. Date: Dec. 8, 1994

[30] Foreign Application Priority Data

May 29, 1993 [GB] United Kingdom ..... 9311215

[51] Int. Cl.[6] ..... B21B 45/02; B21D 22/00; B21D 22/21

[52] U.S. Cl. ..... 72/45; 72/349; 72/43

[58] Field of Search ..... 72/39, 41, 43, 72/44, 45, 347, 348, 349

[56] References Cited

U.S. PATENT DOCUMENTS

| | | | |
|---|---|---|---|
| 3,670,543 | 6/1972 | Bolt et al. | 72/41 |
| 3,943,740 | 3/1976 | Bartenstein | 72/45 |
| 4,223,544 | 9/1980 | Main | 72/45 |
| 4,262,512 | 4/1981 | Maeder | 72/45 |
| 4,300,375 | 11/1981 | Maeder et al. | 72/45 |
| 4,324,124 | 4/1982 | Maeder | 72/345 |
| 4,554,815 | 11/1985 | Weishalla | 72/349 |
| 5,020,350 | 6/1991 | Knepp et al. | 72/45 |

*Primary Examiner*—Lowell A. Larson
*Assistant Examiner*—Rodney A. Butler
*Attorney, Agent, or Firm*—Diller, Ramik & Wight PC

[57] ABSTRACT

An annular device (10) particularly for use as a spacer between dies (200) in a drawing and wall ironing process, the device including an outer delivery channel (30) which is linked to an inner delivery channel (40) by angled slots (50), so that liquid passing from the outer to the inner channel merges in the inner channel to form a vortex of fluid. The device also includes a lip (42) on the wall of the inner channel adjacent to the bore of the device, which serves as directing means to force the merged vortex of liquid out of the spacer in a longitudinal manner for cooling, lubricating and washing adjacent members.

13 Claims, 5 Drawing Sheets

Fig.5a.
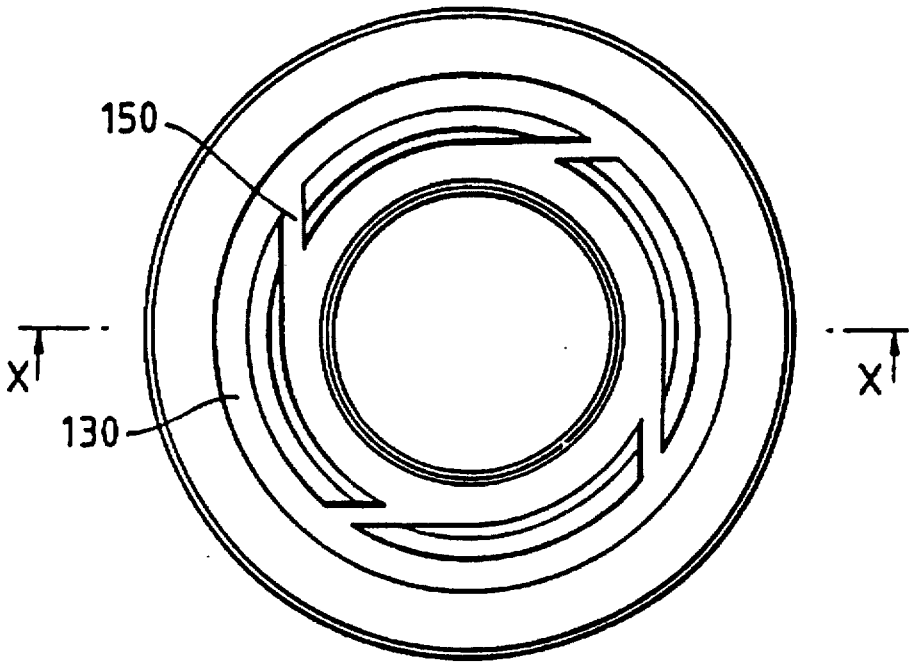
Fig.5b.
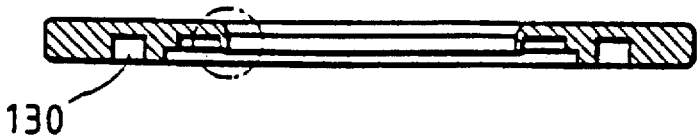
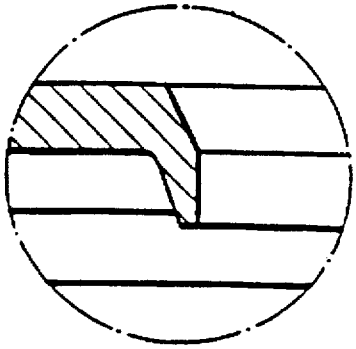
Fig.5c

Fig. 6a.
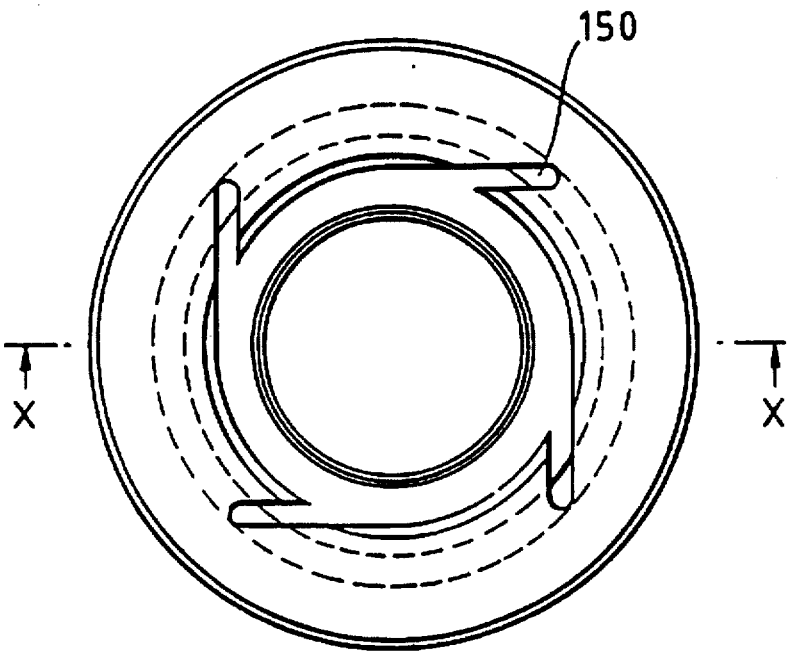
Fig. 6b.
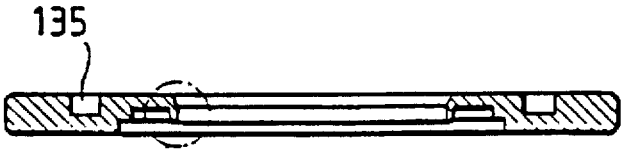
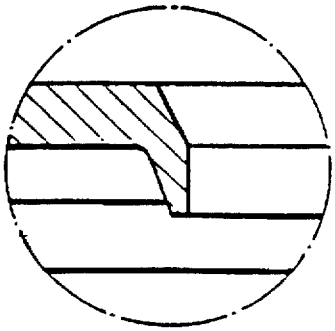
Fig. 6c

SPACER

This invention relates to an annular device for use as a spacer. In particular, it relates to an annular device for spacing apart dies in a die-ring assembly such as are used, for example, in carrying out a drawing and wall ironing (DWI) process for producing can bodies.

In a DWI process, it is necessary to direct a coolant liquid under pressure towards a can passing through the die assembly and also to supply liquid to lubricate the dies so as to reduce frictional forces in the DWI process. In addition, liquid is needed to wash the tooling in the die assembly and flush away any debris formed during the process within the assembly.

DE-2639595 (equivalent to GB-1512744) describes a can bodymaker which has a die lubricant nozzle comprising a die pack spacer ring and a lubricant distribution ring. Pressurised lubricant is fed into the device via radial and axial supply openings into an annular chamber from which lubricant passes through an orifice formed by angled annular surfaces of the spacer and distribution ring onto adjacent components.

GB-A-2181082 describes a DWI process in which coolant fluid is directed in a longitudinal and tangential manner relative to the can so as to create a vortex of fluid swirling around and along the can. Coolant supply spacer rings and damping rings are provided with tangential passages along which fluid passes so that the can is subjected to a series of tangentially directed high pressure jets which create a vortex of coolant/lubricant.

In order to create a vortex of liquid, a large number of passages in the form of small holes are required in the spacer so that the jets are fast and can merge before the liquid reaches the working part of the assembly tooling. A merged vortex is required in order to achieve even cooling, washing and lubrication. The manufacture of tangential holes in an essentially cylindrical component is, however, extremely difficult and expensive to achieve. Furthermore, such small holes are susceptible to blockages which reduce the effectiveness of the coolant/lubricant.

According to the invention, there is provided an annular device for spacing apart dies in a die-ring assembly for delivering a vortex of liquid to an adjacent member, the device comprising:

first and second end walls, a first end wall including an inner delivery channel; a central bore; and directing means separating the inner channel from the bore; characterised by a first outer delivery channel in the first end wall; and at least one angled slot linking the outer and inner channels, for providing the liquid with a rotational component of velocity; and in that, in use, a merged vortex of liquid forms in the inner channel and the directing means directs the merged vortex of liquid longitudinally towards the adjacent member. Since the liquid merges in the inner channel, a continuous flow of lubricant is supplied to the adjacent member and, in the case of liquid coolant, even cooling of the adjacent member can be better achieved.

Preferably, each slot is at at least a grazing angle to the radius and still more preferably at between 45° and tangential. It is essential only that some rotational component of velocity is able to be imported to the liquid so as to achieve a vortex of liquid in the inner channel.

The annular device may typically be a spacer between different dies in a DWI process. Unlike known spacers, the device of the present invention does not supply only a conical or spiral flow of liquid but a merged vortex of liquid which is directed longitudinally towards the adjacent member. The liquid passes through the slots and merges in the inner delivery channel so that a merged vortex of liquid is already formed within the device and is then directed radially inwards and axially onto a workpiece as the workpiece passes through the bore, or onto adjacent died, for example.

Preferably, the device further comprises a second outer delivery channel in the other end wall and at least one passage joining the first and second outer delivery channels. Such a device is usually thicker than that with an outer delivery channel at only one end and is suitable for supplying liquid to or receiving liquid from passages in adjacent members.

It may also be used to provide a wider die spacing, if necessary. Alternatively, the device may be made thinner than known spacers. This is particularly useful if the device is to be used primarily to supply coolant to adjacent members rather than to act as a spacer. Different devices can be readily made different sizes since each device is adaptable as to where the liquid is received. It is also possible to make a thin device simply by turning and milling operations The liquid may flow through the device at between 5 l/min and 120 l/min and may be supplied to the device at a pressure of at least one bar. This range of flow rates is a significantly greater range than previous flow rates which were typically between 15 l/min and 40 l/min.

The lower flow rates which may be used are possible because the liquid is directed more effectively and at higher velocity than with previous devices. The higher flow rates which may be used are possible because the device offers less resistance to flow than previous devices with a large number of small passages.

The directing means preferably comprises a lip which may be at an angle of between 0 and 60 degrees to the central axis of the device. Preferably, the angle is at least 10 degrees. The angle is preferably selected so as to provide the desired longitudinal component of velocity to the liquid. The directing means may further comprise a directing channel which is preferably formed between the lip and a separate annular device. This separate device forms a closure member which may be an adjacent die component or it may be in the form of a cover which engages the inner channel and may partially close the exit of the or each slot. The closure of the slot exit(s) restricts their cross-sectional area to a prechosen value so that the velocity of fluid through the slot(s) into the inner channel is high but the area is not reduced to such an extent that the volume of liquid flowing from the device is insufficient to cool, lubricate or wash adjacent members. Preferably, this area is between 4 $mm^2$ and 60 $mm^2$ per slot.

The directing channel is preferably an annular orifice between the lip and the closure member. The surface of the closure member which forms one side of this directing channel may be generally cylindrical or conical. The cross-sectional area of the directing channel may thus also be preselected so that liquid leaves the directing channel with a longitudinal velocity which is in proportion to the rotational velocity to direct liquid to wash, cool and/or lubricate working portions of adjacent members.

A typical minimum net velocity may be 0.5 m/s, however it is preferable to maximise velocity in order to achieve optimum washing and cooling.

The length of the directing channel is determined by the overlap of the closure member with the lip of the inner channel and must not be too long in relation to its width or the rotational component of the velocity of the liquid may be lost. Ideally the length of the directing channel should be less than 3 times its width.

According to a further aspect of the present invention, there is provided a method for delivering a vortex of liquid from an annular device to an adjacent member, comprising introducing liquid under pressure to a first outer delivery channel, passing the liquid along at least one angled slot from the outer delivery channel to an inner delivery channel, creating a merged vortex of liquid in the inner channel and directing the merged vortex towards the adjacent member.

Preferably the method comprises delivering a vortex of liquid from the annular device according to the first aspect of the present invention.

A preferred embodiment of annular device will now be described by way of example only, with reference to the drawings, in which.

FIG. 5*a* is an alternative embodiment of spacer in plan view;

FIG. 5*b* is a section along X—X of the embodiment of FIG. 5*b;*

FIG. 5*c* is an enlarged view of the encircled portion of FIG. 5*b;*

FIG. 6*a* is a further embodiment of spacer in plan view;

FIG. 6*b* is a section along X—X of the embodiment of FIG. 6*a;*

FIG. 6*c* is an enlarged view of the encircled portion of FIG. 6*b*; and

Figure 7:
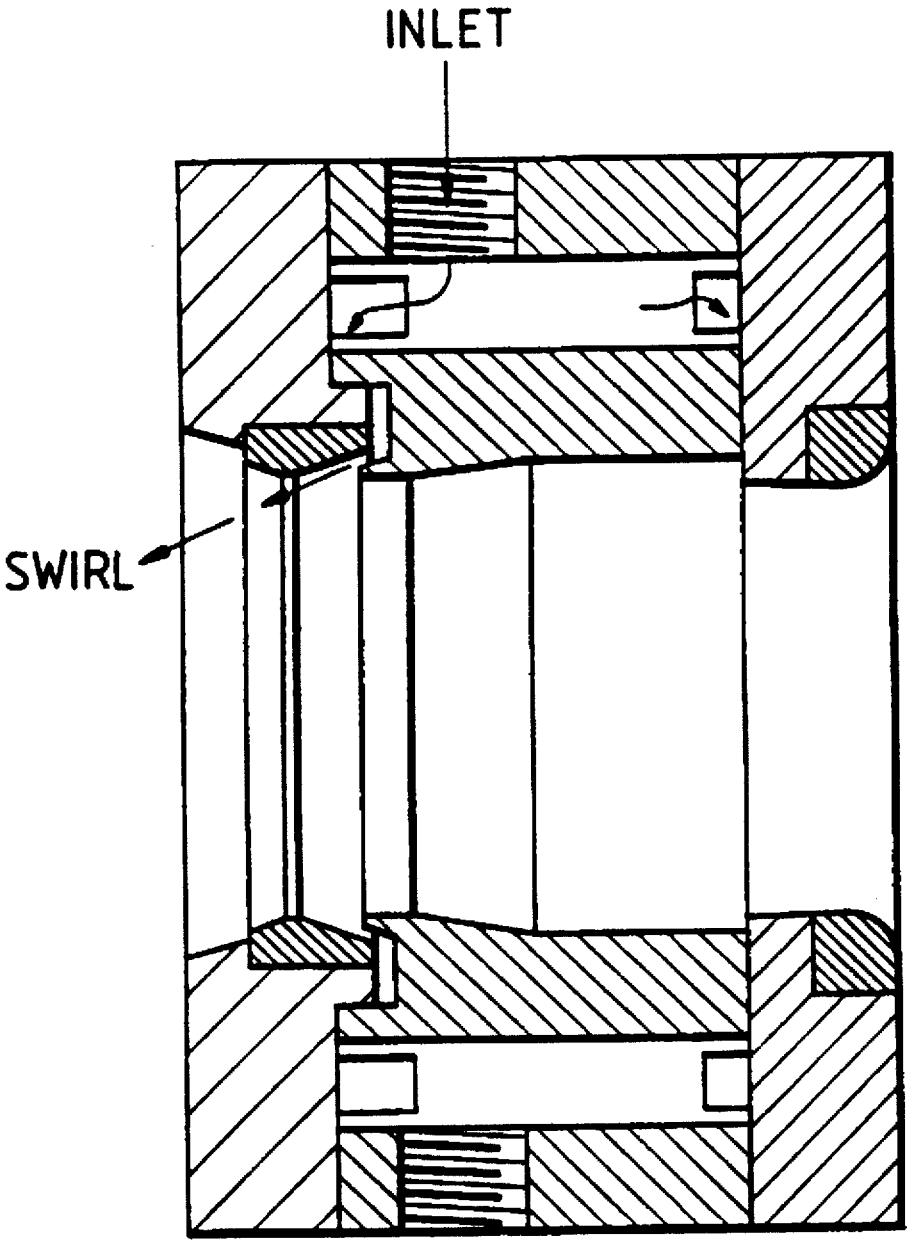

FIG. 7 is a side section of another embodiment of the spacer between DWI dies.

Referring to FIGS. 1 to 4, there is shown generally a spacer comprising an annular device 10 in the form of a hollow spacer. A first end 20 of the spacer has an outer delivery channel 30 and an inner delivery channel 40, joined by eight tangential slots 50. The other end 25 of the spacer has an outer delivery channel 35 only, which is joined to the outer channel 30 of the first end 20 by three holes 60. A plain or tapped inlet hole 65 connects to one of these three holes 60 so as to supply liquid to the outer channels 30 and 35.

A drain hole 70 allows excess liquid to be drained from the tooling of the DWI assembly after the liquid has served its purpose of cooling, washing and lubricating the tooling. A tapped hole 75 may also be provided to which an eyebolt can be connected to faciliate lifting of the device.

The inner delivery channel 40 is separated from the bore 80 of the spacer by a lip 42 which is generally at an angle of between 0 and 60 degrees to the central axis.

Figure 1:
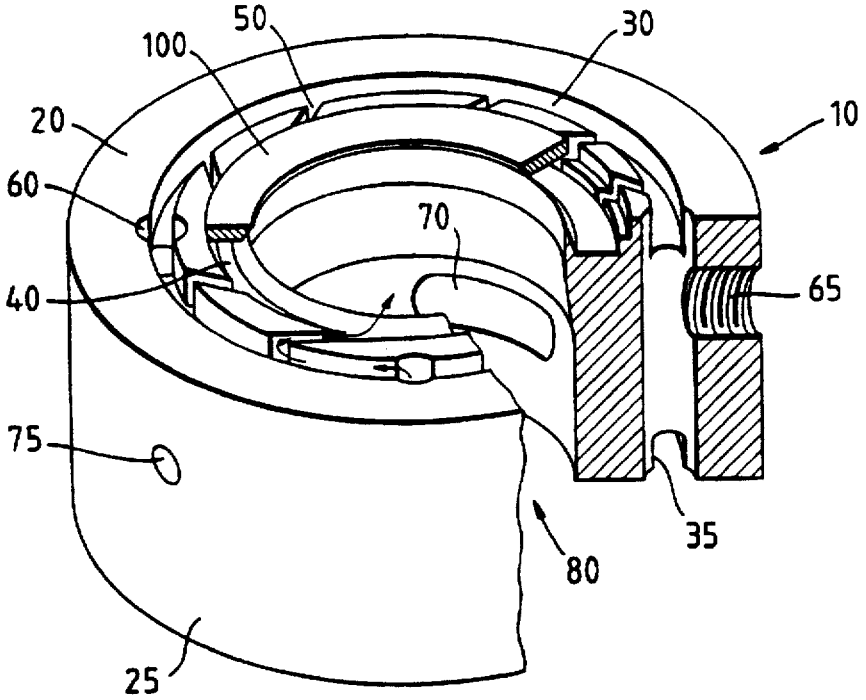
FIG. 1 is a partially cut-away perspective view of a spacer with a cover in position.
Figure 2:
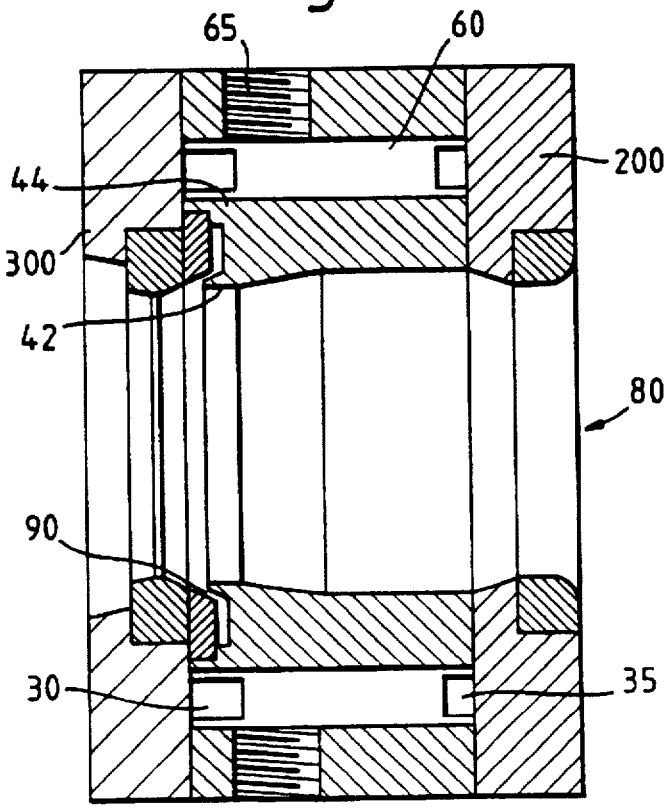
FIG. 2 is a side section of the spacer of FIG. 1 in position between DWI dies.
Figure 3:
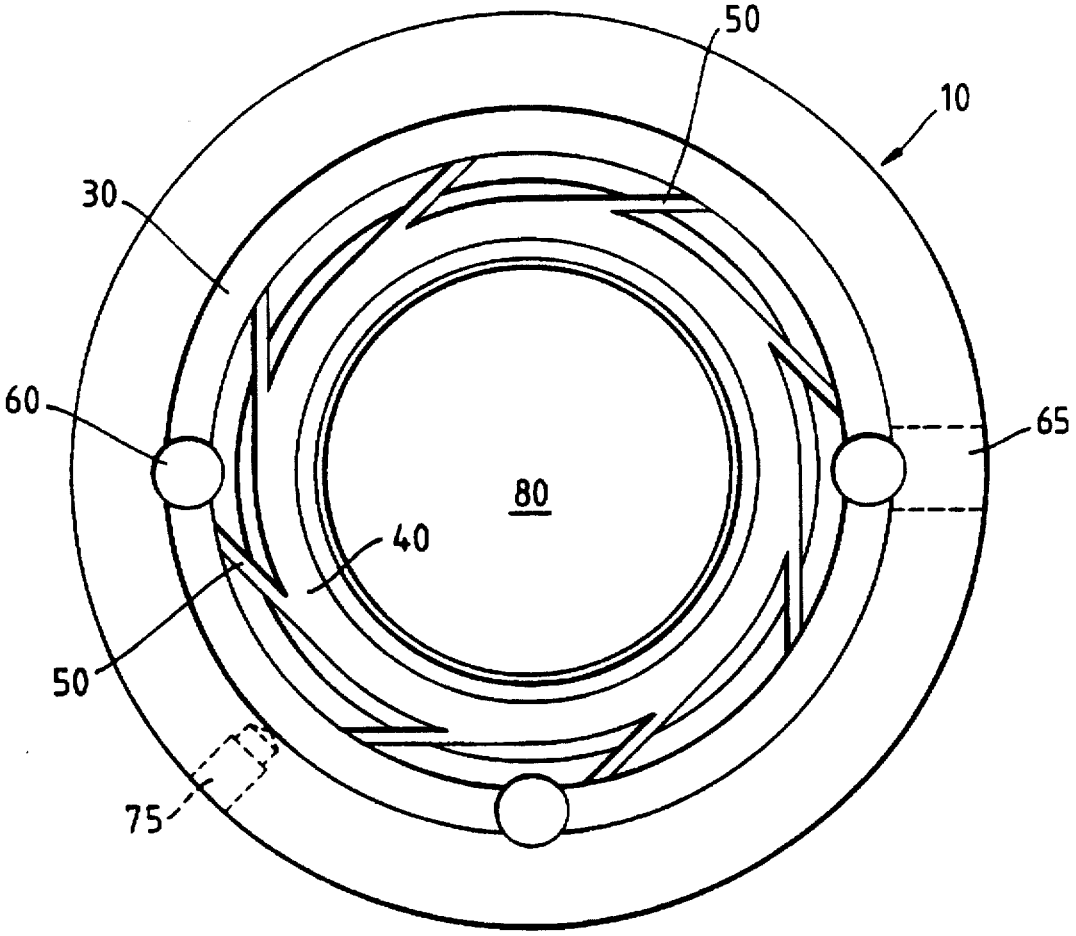
FIG. 3 is a plan view of the spacer of FIG. 1, without cover.
Figure 4:
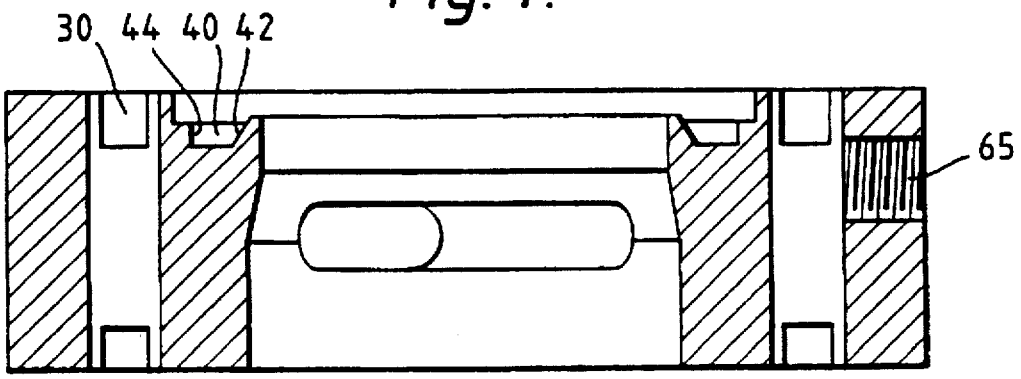
FIG. 4 is a side section of the spacer of FIG. 1, without cover.

In this example, this angle is at 20 degrees to the central axis. The other side wall 44 of the inner channel is stepped to receive a cover 100 as shown in FIGS. 1 and 2, although alternatively the lip may project beyond the end of the spacer and the adjacent die may serve to close all the channels. A directing channel 90 is formed between the lip 42 and the cover 100. The cover 100 of the example is general frusto conical so that as shown in the drawings the channel 90 has substantially parallel sides. This is not essential to the operation of the invention, however.

In FIG. 2, the spacer 10 is shown between a die 200 and holder 300 in the tooling of a DWI assembly. From this drawing, it can be seen that the bore 80 of the spacer is generally tapered and may be bushed or treated to assist in guidance of a reciprocating can-forming tool which passes through the bore.

In use, the cover 100 is placed into the inner channel 40 so that the cover sits on the stepped wall 44 of the channel 40. The spacer 10 and cover 100 are then inserted in the tooling as shown in FIG. 2.

Liquid is introduced into the spacer via inlet hole 65 under a pressure of about 3 bar. The liquid is then free to flow between outer channels 30 and 35 via holes 60.

The liquid passes from outer channel 30 along tangential slots 50 into the inner delivery channel 40 where it swirls around to form a merged vortex of liquid.

With the cover 100 in position, the channel 90 formed between the lip 42 of the spacer and the cover provides an exit for the liquid. The vortex liquid formed in the inner channel 40 is thus directed by the lip in a longitudinal manner out of the spacer and the adjacent die or dies.

This die is thus wetted before a can or reciprocating punch travelling along the bore strikes the die.

The cover 100 restricts the cross-sectional area of the downstream end of the slots 50 to a prechosen area so that the velocity of the liquid flowing from the ends of the slots 50 into the inner channel is high. The area is not reduced to such a degree that the cover and spacer would not allow a sufficient volumetric flow rate or that there is the risk of blockages at these exits.

A high velocity tangential flow of liquid thus emerges from each slot 50 into the inner channel 40 where it merges to form a rotating mass of liquid.

The angle and cross-sectional area of channel 90 are small so that the liquid leaves the channel with a longitudinal velocity which is high enough to cool, wash and lubricate the adjacent tooling satisfactorily. The length of the channel 90 is determined by the overlap between the cover 100 and the inner channel 40 and is short so that there is minimal loss of the rotational component of velocity obtained by the liquid in the inner channel 40.

The cross-sectional area of the channel 90 must not, however, be too small since this too would cause excessive loss of the rotational component of velocity by fluid friction effects.

In one example of spacer, a suitable flow pattern was obtained with a spacer having eight tangential slots, as shown in FIGS. 1 to 4, each slot having an exit cross-sectional area of 2.5 mm×2.75 mm and in which the directing channel 90 had a minimum width of 0.7 mm, a circumference of 217 mm, and a length of 1.3 mm.

Flow rates of between 60 and 120 liters/min were successfully carried out and the improved flow achieved by the device clearly demonstrated that a flow as low as 15 liters/min and below as well as greater than 120 liters/min is possible with the spacer of the present invention.

Referring to FIGS. 5*a* through 5*c*, a second embodiment of spacer is shown, in which the spacer has been made thinner by having an outer channel 130 at one end only and with the liquid being supplied via an adjacent die rather than through an inlet hole in the spacer itself.

Similarly, in FIGS. 6*a* through 6*c* the spacer has an outer channel 135 only which connects to four tangential slots 150 at the outer end of the spacer and hence to the inner channel in the same way as the first and second embodiments.

FIG. 7 illustrates an alternative design of die adjacent to a fourth embodiment of spacer. With reference also to FIG. 2, it can be seen that the alternative design of ironing die eliminates the need for the cover 100 and the stepped wall 44 becomes a straight wall.

The spacer of the invention is substantially easier to manufacture than known spacers which require a large number of tangential slots to be drilled in an annular device and is also less susceptible to blockages in the slots than is the case in such prior art spacers.

We claim:

1. An annular device (10) for spacing apart dies in a die-ring assembly for delivering a vortex of liquid to an adjacent member, the device comprising:

first and second end walls, said first end wall including an inner channel (40);

a central bore; and directing means separating the inner channel from the bore;

characterised by:

a first outer delivery channel (30) in the first end wall; and at least one angled slot (50) linking the outer and inner channels, for providing the liquid with a rotational component of velocity;.

and in that, in use, a merged vortex of liquid forms in the inner channel and the directing means directs the merged vortex of liquid longitudinally towards the adjacent member.

2. An annular device according to claim 1, further comprising a second outer delivery channel in the second end wall and at least one passage joining the first and second outer delivery channels.

3. An annular device according to claim 1, in which the directing means comprises a lip (42) which is at an angle of between 0 and 60 degrees to the central axis of the device.

4. An annular device according to claim 1, in which the liquid flows through the device at between 51/min and 120 l/min.

5. An annular device according to claim 1, in which liquid is supplied to the device at a pressure of at least one bar.

6. An annular device according to claim 1, in which the directing means further comprises a separate annular device which acts as a closure member.

7. The annular device as defined in claim 1 wherein at least one of said inner channel (40) and first outer delivery channel (30) is of a continuous annular configuration.

8. The annular device as defined in claim 1 wherein each of said inner channel (40) and first outer delivery channel (30) is of a continuous annular configuration.

9. The annular device as defined in claim 2 wherein at least one of said inner channel (40), first outer delivery channel (30) and second outer delivery channel is of a continuous annular configuration.

10. The annular device as defined in claim 2 wherein at least two of said inner channel (40), first outer delivery channel (30) and second outer delivery channel are of a continuous annular configuration.

11. The annular device as defined in claim 2 wherein each of said inner channel (40), first outer delivery channel (30) and second outer delivery channel is of a continuous annular configuration.

12. An annular device according to claim 6, in which the closure member engages the inner channel and partially closes the exit of the or each slot.

13. A method for delivering a vortex of liquid from an annular spacer device to an adjacent member in a die ring assembly, comprising:

introducing liquid under pressure to a first outer delivery channel;

passing the liquid along at least one angled slot from the outer delivery channel to an inner delivery channel; creating a merged vortex of liquid in the inner channel and directing the merged vortex towards the adjacent member.

* * * * *